US010323910B2

(12) United States Patent
Hershey et al.

(10) Patent No.: US 10,323,910 B2
(45) **Date of Patent: *Jun. 18, 2019**

(54) METHODS AND APPARATUSES FOR ELIMINATING A MISSILE THREAT

(71) Applicant: Raytheon Company, Waltham, MA (US)

(72) Inventors: Paul C. Hershey, Ashburn, VA (US); Joseph O. Chapa, Wakefield, MA (US); Elizabeth Umberger, Duluth, GA (US)

(73) Assignee: Raytheon Company, Waltham, MA (US)

( * ) Notice: Subject to any disclaimer, the term of this patent is extended or adjusted under 35 U.S.C. 154(b) by 567 days.

This patent is subject to a terminal disclaimer.

(21) Appl. No.: 14/481,288

(22) Filed: Sep. 9, 2014

(65) Prior Publication Data

US 2016/0070674 A1 Mar. 10, 2016

(51) Int. Cl.
*F41H 11/02* (2006.01)

(52) U.S. Cl.
CPC ..... *F41H 11/02* (2013.01)

(58) Field of Classification Search
CPC ..... G06F 1/18; F41H 11/02
USPC ..... 703/2
See application file for complete search history.

(56) References Cited

U.S. PATENT DOCUMENTS 8,489,522 B1 * 7/2013 Hirsch ..... G06N 20/00 706/12
9,544,326 B2 * 1/2017 Hershey ..... F41H 11/00
2004/0138935 A1 * 7/2004 Johnson ..... G06Q 10/10 705/7.37
2005/0033710 A1 * 2/2005 Cochran ..... G06Q 10/00 706/45
2012/0000349 A1 * 1/2012 Couronneau ..... F41G 3/04 89/1.11

(Continued)

OTHER PUBLICATIONS

Guzie, G. Integrated Survivability Assessment [online], Apr. 2004 [retrieved on Dec. 16, 2016]. Retrieved from the Internet: <URL: http://www.dtic.mil/dtic/tr/fulltext/u2/a422333.pdf>.*

(Continued)

*Primary Examiner* — Rehana Perveen
*Assistant Examiner* — Justin C Mikowski
(74) *Attorney, Agent, or Firm* — Schwegman Lundberg & Woessner, P.A.; Gregory J. Gorrie

(57) ABSTRACT

Embodiments of a method and apparatus for eliminating a missile threat are generally described herein. In some embodiments, the method includes identifying a vulnerability associated with the missile threat. The method can further include identifying a technique for exploiting the vulnerability to generate a vulnerability-technique (VT) pair. The method can further include applying a stochastic mathematical model (SMM) to generate a negation value, the negation value being representative of a probability that the technique of the respective VT pair will eliminate the threat by exploiting the vulnerability. The method can further include providing a recommendation for implementation the technique to eliminate the missile threat responsive to receiving a user selection of the technique, the user selection being selected based on the generated negation value. Other example methods, systems, and apparatuses are described.

16 Claims, 5 Drawing Sheets

(56) References Cited

U.S. PATENT DOCUMENTS

2013/0234864 A1* 9/2013 Herman ..... G08G 1/00
340/901
2016/0269378 A1* 9/2016 Ye ..... G06N 3/0454

OTHER PUBLICATIONS

Guzie, G. Vulnerability Risk Assessment [online], Jun. 2000 [retrieved on Dec. 16, 2016]. Retrieved from the Internet: <URL: http://www.dtic.mil/dtic/tr/fulltext/u2/a378836.pdf>.*

Serfozo, R. Basics of Applied Stochastic Processes [online]. Springer Berlin Heidelberg, 2009 [retrieved on Dec. 21, 2016]. Retrieved from: STIC Catalog. Accession No. stic.221127. Preface, p. vii, ISBN-978-3-540-89332-5.*

Oracle Crystal Ball, Fusion Edition: User's Guide. Selecting Probability Distributions [online], Release 11.1.1.3.00. 2009 [retrieved Aug. 14, 2017]. Retrieved from the Internet <https://docs.oracle.com/cd/E12825_01/epm.111/cb_user/frameset.htm?ch01s04.html>.*

Richard Maher, The Covert War Against Iran's Nuclear Program: An Effective Counterproliferation Strategy?, 2012, European University Institute Badia Fiesolana I-50014 San Domenico di Fiesole (FI), 1-14 (Year: 2012).*

* cited by examiner

300

| VULNERABILITY–TECHNIQUE PAIRS (304) | MFGR/PROD (306) | | | TEST (308) | | | FIELDING (310) | | | BOOST (312) | | |
|---|---|---|---|---|---|---|---|---|---|---|---|---|
| | VULNERABILITY #1 | VULNERABILITY #2 | ... | VULNERABILITY #3 | VULNERABILITY #4 | ... | VULNERABILITY #5 | VULNERABILITY #6 | ... | VULNERABILITY #7 | VULNERABILITY #8 | ... |
| TECHNIQUE #1 | ● | | | | | | ● | | | | | |
| TECHNIQUE #2 | | | | | ● | | | | | | | |
| TECHNIQUE #3 | | ● | | | | | | | | | | |
| TECHNIQUE #4 | | | | ● | | | | | | | | |
| TECHNIQUE #5 | | | | | | | | | | | | |
| TECHNIQUE #6 | | ● | | | | | ● | | | | | |
| TECHNIQUE #7 | | | | | | | | | | | | |
| TECHNIQUE #8 | | | | | ● | | | | | | | |
| TECHNIQUE #9 | | | | | | | | | | | | |
| TECHNIQUE #10 | ● | | | | ● | | ● | | | | | |
| TECHNIQUE #11 | | | | | | | | ● | | | | |
| TECHNIQUE #12 | | | | | | | | | | ● | | |
| TECHNIQUE #13 | | | | | | | | | | | ● | |
| TECHNIQUE #14 | | | | | | | | ● | | | | |
| TECHNIQUE #15 | | | | | | | | | | | ● | |
| TECHNIQUE #16 | | | | | | | | ● | | | | |
| TECHNIQUE #17 | | | | | | | | | | ● | | |
| TECHNIQUE #18 | | ● | | | | | ● | | | | | |
| TECHNIQUE #19 | | | | | | | | | | | ● | |
| TECHNIQUE #20 | | | | | | | | | | | ● | |

302 314 316 318

*Fig. 3*

METHODS AND APPARATUSES FOR ELIMINATING A MISSILE THREAT

TECHNICAL FIELD

Some embodiments relate to missile defense. Some embodiments relate to methods for identifying and exploiting vulnerabilities in missile threats.

BACKGROUND

Currently-available techniques for missile defense performance assessment focus on kinetic solutions to counter ballistic missile threats. Such techniques are incomplete because they do not account for all available types of countermeasures. Ongoing efforts are directed to improving techniques for missile defense performance enhancement, including techniques that account for all available types of countermeasures.

BRIEF DESCRIPTION OF THE DRAWINGS

FIG. 3 is an example chart of vulnerability-technique (VT) pairs as can be generated in accordance with some embodiments;

DETAILED DESCRIPTION

Figure 1:
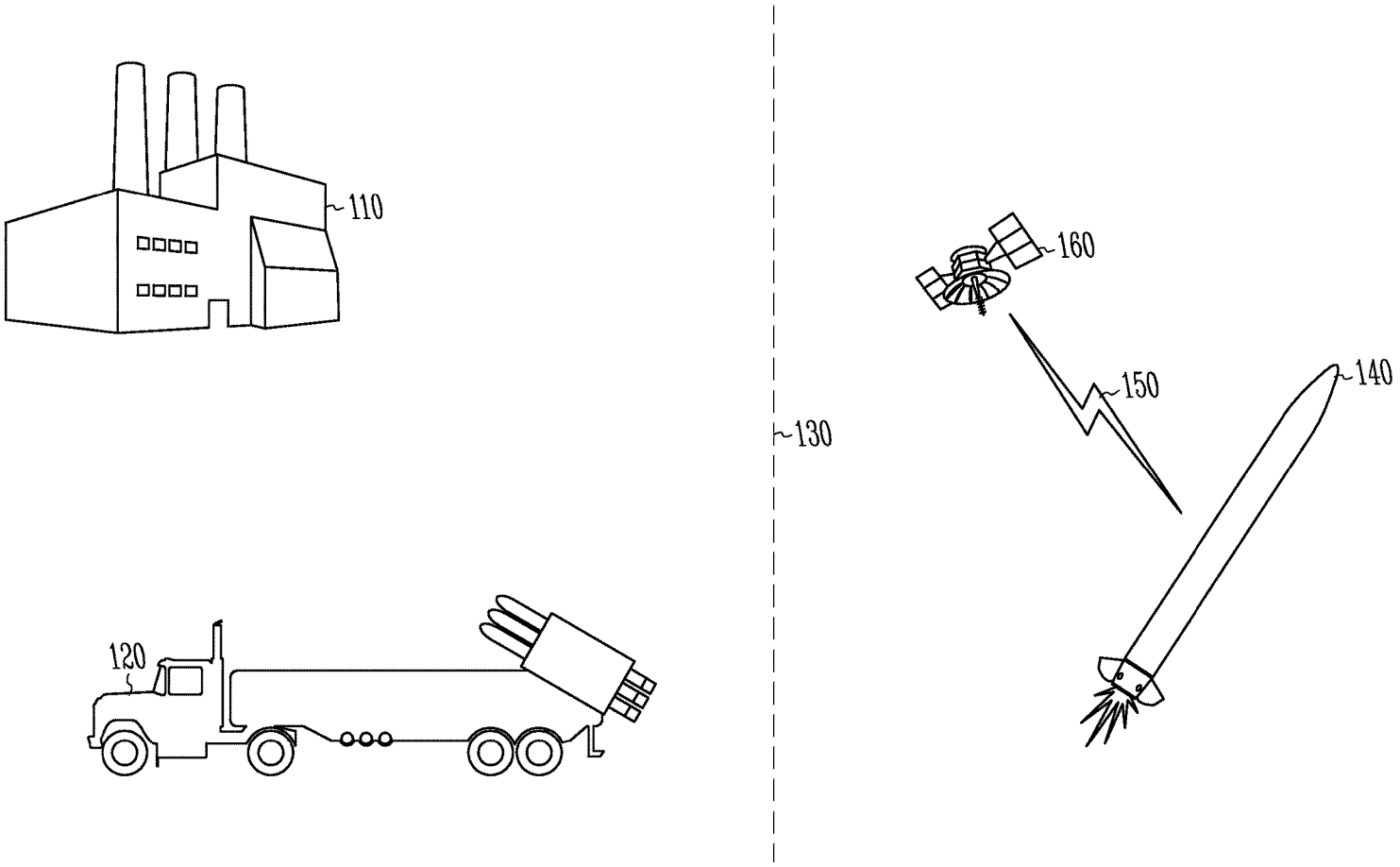
FIG. 1 illustrates some phases in which example embodiments can be implemented.

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Current-available analytical techniques for missile defense performance assessment focus on kinetic solutions to counter ballistic missile threats. The term "kinetic" in the context of describing example embodiments refers to actions or countermeasures to threats taken through physical, material means, such as nuclear bombs, rockets, and other munitions. Some available analytical techniques focus on measures of effectiveness (MOE) that include probability of engagement success (Pes), which takes into account multiple kinetic interceptor shots each with a probability of single shot engagement kill (Pssek). Currently-available analytical techniques derive Pssek from measurements or estimations of several factors along the kinetic kill chain. These factors can include reliability of the combat system, communications system, and interceptor and the ability of the interceptor to intercept the re-entry vehicle of the ballistic missile.

However, currently-available methods for determining Pes do not consider non-kinetic means to counter ballistic missile threats and are thus incomplete. Currently-available methods may only consider expensive kinetic actions to be taken starting from a boost phase of a ballistic missile threat, when the ballistic missile threat has already been deployed. Non-kinetic solutions in the context of example embodiments are logical, electromagnetic, or behavioral. One easily-understood example would be a cyber-attack on an enemy computer system. Unlike most kinetic solutions, such non-kinetic solutions are typically used before the boost phase.

Currently available methods may be unable to calculate engagement success for non-kinetic countermeasures. It may be more difficult, relative to kinetic countermeasures, to calculate engagement success for non-kinetic countermeasures because physical measurements for success for these countermeasures may be difficult to define. When a non-kinetic measure is taken against a threat, it may be relatively difficult to ascertain that the non-kinetic measure did, in fact, directly cause a failure of the threat because it may be difficult or impossible to observe the non-kinetic countermeasures taking place inside the enemy system. Calculation of engagement success for non-kinetic countermeasures, therefore, can require calculation of probability of placement, and the probability that the non-kinetic countermeasure can actually be activated, in addition to the probability that the non-kinetic countermeasure will be successful in destroying or disabling the threat. Calculation of engagement success for non-kinetic countermeasures is further complicated by the fact that some non-kinetic countermeasures may be in place for months or years. In contrast, kinetic countermeasures are typically very visible and observable, in a relatively short time frame that can be measured in minutes or even seconds.

Furthermore, currently-available systems may not provide an indication of the level of confidence that operators can have in the predicted success of countermeasures, which can make it difficult for agencies to justify large expenditures for kinetic countermeasures. Finally, available methods do not consider the use of confidence levels in the effectiveness of various techniques in eliminating threats when determining whether to apply those various techniques. Accordingly, it may be difficult to optimize and coordinate usage of multiple countermeasure techniques against enemy vulnerabilities.

Methods, apparatuses, and systems described herein for implementing various embodiments provide more comprehensive ways to provide analytic assessment of missile defense operations, by considering mitigation of ballistic missile threats before launch (e.g., "left of launch") of such threats, in addition to assessment of certain countermeasures during and after the boost phase of a ballistic missile threat. Embodiments implement a stochastic mathematical model (SMM) for computation of Probability of Ballistic Missile Negation ($P_n$), for left of launch techniques implemented against missile production, fielding and deployment, and boost vulnerabilities. In addition, systems, methods, and apparatuses of some embodiments can provide a quantifiable indicator of the level of confidence that governmental and military agencies can take in these probability computations.

FIG. 1 illustrates some phases in which example embodiments can be implemented. For example, as shown in FIG. 1, embodiments can consider non-kinetic countermeasures implemented in manufacturing, product, and test phases 110. Such countermeasures can include the inducing of kinetic material defects within materials used in ballistic missile manufacturing, or causing failures within the design and specification process for the threat. Such countermeasures can cause defects in materials early in manufacturing phases such that the defects propagate throughout the missile's entire life cycle.

Some embodiments can consider countermeasures implemented in fielding and deployment phases 120. Such countermeasures can include disrupting launch, further degradation of material integrity, disrupting logistics, inducing failures during hardware and software upgrades, affecting the calibration and maintenance of the threat, etc. Phases 110 and 120 can be understood as being left of launch 130.

Some embodiments can analyze the success of countermeasures implemented in a boost phase 140. Such countermeasures can include disrupting or degrading material integrity, disrupting uplinks 150, initiating self-destruction of missiles, disrupting guidance systems or communication systems 160, etc.

Figure 2:
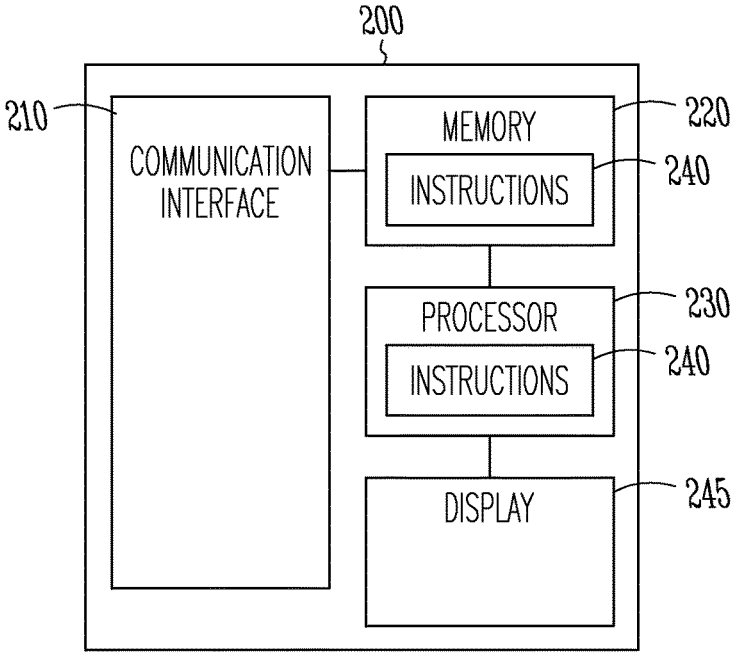
FIG. 2 is a block diagram of a computer for implementing methods to eliminate a missile threat according to example embodiments.

FIG. 2 is a block diagram of a computer 200 for implementing methods to eliminate a missile threat according to example embodiments.

The computer 200 will include a communication interface 210. The communication interface 210 will receive identification information identifying a vulnerability associated with a missile threat. Further, the communication interface 210 will receive identification information identifying a technique for exploiting the vulnerability. The communication interface 210 can retrieve this information from memory 220 or store such received information into memory 220.

The computer 200 includes at least one processor 230. The processor 230 will generate at least one vulnerability-technique (VT) pair based on information received by the communication interface 210. FIG. 3 is an example chart 300 of VT pairs as can be generated in accordance with some embodiments. The upper row 302 lists various vulnerabilities 304 that can occur at various phases of a threat's life cycle. The illustrated phases include a manufacturing and production phase 306, a test phase 308, a fielding phase 310, and a boost phase 312, although embodiments are not limited to any particular number of phases and phase identifiers are not limited to any particular identifiers. Missile design and manufacturing engineers or other experts or computer systems can assess and identify these vulnerabilities.

Column 314 lists various techniques 318 for exploiting and manipulating each vulnerability. Cyber-engineers, electronic warfare experts, or other experts or computer systems can identify these techniques. The techniques 318 can include cyber weapons, directed energy, electronic warfare, etc. Cyber weapons can include digital techniques that can disrupt or destroy hardware or software components of a computerized system or network. Directed energy techniques can include targeted electromagnetic pulse (EMP). Electronic warfare techniques can exploit wireless vulnerabilities. The multiple techniques 318 may be independent such that the desired effect is achieved if one or more of the techniques 318 are successfully implemented. Conversely, the multiple techniques 318 may only result in the desire effect when all of the techniques 318 are successfully implemented.

Subject matter experts (SMEs) can then identify one or more VT pairs 316. SMEs can assign a score (not shown in FIG. 3) to each VT pair 316 representing the likelihood that the given technique 318 can exploit the given vulnerability 304. In embodiments, this score includes a judgment based on the experience of the SME. While scoring systems provide a relative ranking for the VT pairs 316 versus a probability of engagement success, apparatuses and methods described herein with respect to various embodiments further allow experts to associate probability distributions, derived as described later herein, with the confidence levels that these experts have in the likelihood that a technique will negate a vulnerability.

The processor 230 will apply an SMM to generate a negation value $P_n$ that represents the probability that techniques 318 of respective VT pairs 316 will eliminate the threat by exploiting the respective vulnerability 304.

The negation value $P_n$ can be decomposed into several components as described below with reference to Equations (1)-(30). In embodiments, the negation value $P_n$ will include four components, but other embodiments can include more or fewer components. There is no theoretical limit on the number of components used, but computational time will typically be faster when the negation value $P_n$ includes fewer, rather than more, components. Confidence levels in results may be higher, however, when the negation value $P_n$ includes more, rather than fewer, components.

Each component represents a different criterion or combination of criteria for estimating the probability that implementation of the respective technique 318 will eliminate the missile threat. These criteria can be selected from a list including, but not limited to: a placement criterion to represent whether an instrumentality for executing the technique 318 can be placed in a manner to exploit the vulnerability 304; an activation criterion to represent whether the technique 318 can be activated subsequent to placement of the instrumentality for executing the technique 318; a success criterion to represent whether implementation of the technique 318 can exploit the corresponding vulnerability 304; and a severity criterion to represent the severity with which the vulnerability 304 affects operation of the missile threat.

Success is defined in the context of example embodiments to refer to a measure of whether the technique 318 performed as the technique 318 was designed to perform. Severity is defined in the context of example embodiments to refer to a measure of whether the technique 318 had a significant impact on threat performance. For example, a first technique 318 when successful may have the effect of changing the color of a piece of hardware, whereas a second technique 318 when successful causes the hardware to break apart under acoustic loads. Even if the probability of success for each of the first technique 318 and the second technique 318 were the same, the probability of being severe is much higher for the second technique 318 than for the first technique 318. Accordingly, given the same probability of success for each technique 318, the probability of effectiveness would be higher for the second technique 318 than for the first technique 318.

In embodiments, the processor 230 will decompose the negation value $P_n$ according to at least the following equations and principles.

First, it will be appreciated that, in order to eliminate a threat, a VT pair 316 must be both deployed and effective:

$$P_n = P(e,d) \tag{1}$$

where P(e,d) is the probability of a technique 318 being both deployed d and effective e against a given vulnerability 304. If a technique 318 is not deployed or not effective, then the missile will not be negated.

Also, since a technique 318 cannot be effective if it is not deployed:

$$P(e|\sim d)=0 \tag{2}$$

Likewise:

$$P(\sim e|d)=1 \quad (3)$$

Therefore:

$$P(e,\sim d)=P(e|\sim d)P(d)=0 \quad (4)$$

Likewise:

$$P(\sim e,\sim d)=P(\sim e|\sim d)P(\sim d)=P(\sim d)=1-P(d) \quad (5)$$

Based on the law of total probability, for a given VT pair, $V_iT_j$:

$$P(d)=P(e,d)+P(\sim e,d) \quad (6)$$

$$P(\sim d)=P(e,\sim d)+P(\sim e,\sim d)=1-P(d) \quad (7)$$

$$P(e)=P(e,d)+P(e,\sim d)=P(e,d)=P_n(V_iT_j) \quad (8)$$

$$P(\sim e)=P(\sim e,d)+P(\sim e,\sim d)=1-P(e) \quad (9)$$

Applying Bayes' theorem gives:

$$P(e,d)=P(e|d)\times P(d) \quad (10)$$

In turn, for a VT pair 316 to be effective, the technique 318 must be successful su and severe sv:

$$P(e|d)=P(sv,su) \quad (11)$$

Equation (11) signifies that if a VT pair 316 is not successful or not severe, then the VT pair 316 will not be effective given it is deployed.

Also, since a VT pair 316 cannot be severe if it is not successful:

$$P(sv|\sim su)=0 \quad (12)$$

Likewise:

$$P(\sim sv|\sim su)=1 \quad (13)$$

Therefore:

$$P(\sim su,sv)=P(sv|\sim su)P(\sim su)=0 \quad (14)$$

Likewise, $$P(\sim su,\sim sv)=P(\sim sv|\sim su)P(\sim su)=P(\sim su)=1-P(su) \quad (15)$$

Based on the law of total probability:

$$P(su)=P(su,sv)+P(su,\sim sv) \quad (16)$$

$$P(\sim su)=P(\sim su,sv)+P(\sim su,\sim sv)=1-P(su) \quad (17)$$

$$P(sv)=P(su,sv)+P(\sim su,sv)=P(su,sv)=P(e|d) \quad (18)$$

$$P(\sim sv)=P(su,\sim sv)+P(\sim su,\sim sv)=P(su)-P(su,sv)+1-P(su)=1-P(su,sv) \quad (19)$$

Applying Bayes' theorem gives:

$$P(e|d)=P(sv|su)\times P(su) \quad (20)$$

Equation (20) signifies that the processor 230 will receive inputs representative of the probability of a VT pair 316 being severe given that it is successful (e.g., P(sv|su)), and the probability of a VT pair 316 being successful (e.g., P(su)). The processor 230 will receive inputs of these probabilities from an SME, for example, or a computer system, as described in more detail herein with reference to FIG. 4.

Finally, in order for a VT pair 316 to be deployed d, the VT pair 316 must be placed pl and activated a:

$$P(d)=P(a,pl) \quad (21)$$

where P(a,pl) is the probability of a VT pair 316 being both placed and activated, and therefore deployed.

If a VT pair 316 is not placed or not activated, then the VT pair 316 will not be deployed. Also, since a VT pair 316 cannot be activated if it is not placed:

$$P(a|\sim pl)=0 \quad (22)$$

Likewise:

$$P(\sim a|\sim pl)=1 \quad (23)$$

Therefore, $$P(a,\sim pl)=P(a|\sim pl)P(\sim pl)=0 \quad (24)$$

Likewise, $$P(\sim a,\sim pl)=P(\sim a|\sim pl)P(\sim pl)=P(\sim pl)=1-P(pl) \quad (25)$$

Based on the law of total probability, $$P(a)=P(a,pl)+P(a,\sim pl)=P(a,pl)=P(d) \quad (26)$$

$$P(\sim a)=P(\sim a,pl)+P(\sim a,\sim pl)=1-P(a)=1-P(d) \quad (27)$$

$$P(pl)=P(a,pl)+P(\sim a,pl) \quad (28)$$

$$P(\sim pl)=P(a,\sim pl)+P(\sim a,\sim pl)=1-P(pl) \quad (29)$$

Applying Bayes' theorem gives:

$$P(d)=P(a|pl)\times P(pl) \quad (30)$$

Equation (30) signifies that the processor 230 will receive inputs representative of the probability of a VT pair 316 being activated given that it is placed (e.g., P(a|pl)) and the probability of a VT pair 316 being placed (e.g., P(pl)). The processor 230 will receive inputs of these probabilities from an SME, for example, or a computer system, as described in more detail herein with reference to FIG. 4.

By combining Equations (10), (20), and (30) for each technique $T_j$ against vulnerability $V_i$, the probability of negation $P_n$ for VT pair $V_iT_j$ can be written:

$$P_n(V_iT_j)=P(sv_{ij}|su_{ij})P(su_{ij})\times P(a_{ij}|pl_{ij})P(pl_{ij}) \quad (31)$$

The processor 230 will treat each component of Equation (31) as a random variable, with probability distribution functions (PDFs) provided by user input or through automated systems. For example, the processor 230 can treat a first component of Equation (31) as a random variable $RV_1$:

$$RV_1=sv_{ij}|su_{ij} \quad (32)$$

A PDF for $RV_1$ can be expressed as:

$$f_1(sv_{ij}|su_{ij}) \quad (33)$$

The processor 230 can treat a second component of Equation (31) as a random variable $RV_2$:

$$RV_1=su_{ij} \quad (34)$$

A PDF for $RV_2$ can be expressed as:

$$f_2(su_{ij}) \quad (35)$$

The processor 230 can treat a third component of Equation (31) as a random variable $RV_3$:

$$RV_3=a_{ij}|pl_{ij} \quad (36)$$

A PDF for $RV_3$ can be expressed as:

$$f_3(a_{ij}|pl_{ij}) \quad (37)$$

The processor 230 can treat a fourth component of Equation (31) as a random variable $RV_4$:

$$RV_4=pl_{ij} \quad (38)$$

A PDF for $RV_4$ can be expressed as:

$$f_4(pl_{ij}) \tag{39}$$

Figure 4:
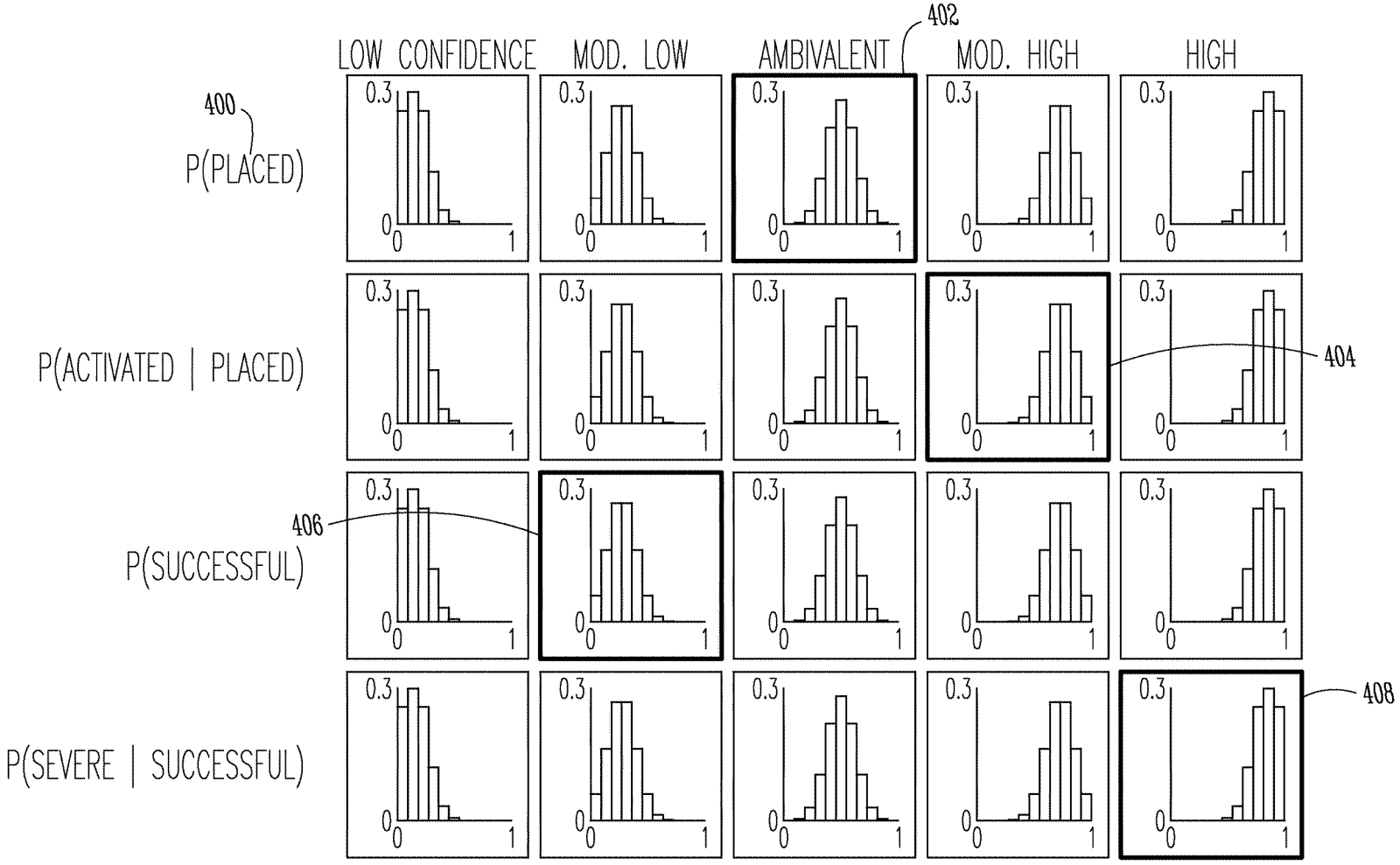
FIG. 4 is an illustrative example of graphical representations for PDFs in accordance with some embodiments as what would be presented to a subject matter expert for each VT pair.

The computer 200 further includes a user display 245 to display graphical representations of the PDFs given by Equations (33), (35), (37) and (39). FIG. 4 is an illustrative example of graphical representations for PDFs in accordance with some embodiments as what would be presented to an SME for each VT pair 316. Each PDF represents a different confidence level associated with the corresponding component. For example, each PDF represents how confident an SME is in that component. While four components (and PDFs) are shown and described, embodiments are not limited to any particular number of components and PDFs.

As shown in FIG. 4, each component 400 has an associated five PDFs representative of different confidence levels. The processor 220 can receive selections of one PDF from each set of PDFs, to generate a set of selected PDFs. The confidence levels can represent how much confidence an operator, such as a SME or analyst, has in that particular component 400.

In the illustrative example, the SME is ambivalent as to whether the corresponding technique 318 (FIG. 3) was placed, so the SME has selected the "Ambivalent" PDF 402 for the relevant component. Similarly, the SME can be relatively more confident that the technique 318 was either activated or placed, and the SME may select PDF 404. The SME may be relatively non-confident that the technique 318 will be successful, and the SME may select PDF 406 to correspond to that component. Similarly, the SME may be relatively confident that the technique 318 will be successful or severe, and the SME may select PDF 408 to correspond to that component.

The processor 230 can generate any number of negation values $P_n$ based on any number of corresponding VT pairs 316. The processor 230 may combine the negation values $P_n$ in several ways to compute the probability that execution of at least one of the techniques 318 of the plurality of VT pairs 316 will successfully exploit the vulnerability 304 to eliminate the threat. For example, in some embodiments, several techniques, $T_1, T_2, \ldots, T_m$, can be deployed to exploit a single vulnerability, $V_i$. These techniques may be independent of each other, that is, any one of them, if effective, will negate the missile. Likewise, the techniques may be highly dependent on one another, that is, the missile will only be negated if all of the techniques are effective.

The processor 230 can calculate a composite technique, $T_j$ that includes m techniques applied to the vulnerability $V_i$, under the assumption that all of the techniques are independent of one other. Then the composite probability of negation is the probability that all m techniques will not be ineffective, or the probability of at least one technique will be effective:

$$P_n(V_i)=1-\Pi_{s=1}^{m}(1-P_n(V_iT_s)) \tag{40}$$

The processor 230 can also calculate a composite technique, $T_j$, comprised of m techniques applied to the vulnerability $V_i$, under the assumption that all of the techniques are dependent on one other. Then the composite probability of negation is the probability that all m techniques are effective:

$$P_n(V_i)=\Pi_{s=1}^{m}P_n(V_iT_s) \tag{41}$$

Likewise, if techniques against q different vulnerabilities must be effective to negate the missile, then the processor 230 calculates the overall probability of negation according to:

$$P_n=\Pi_{t=1}^{q}P_n(V_t) \tag{42}$$

Finally, if techniques against q different vulnerabilities are deployed such that any one of them can negate the missile, then the processor 230 calculates the overall probability of negation according to:

$$P_n=1-\Pi_{t=1}^{q}(1-P_n(V_t)) \tag{43}$$

In each of Equations (41)-(43), $P_n(V_iT_s)$ is calculated using Eq 31.

In reality, the actual case could be a combination of dependent and independent techniques against a single vulnerability and several dependent and independent vulnerabilities against a certain missile.

Once the processor 230 has received the appropriate PDFs for each outcome for each VT pair 316, the processor 230 or other system such as simulator, can model a "kill chain," where a kill chain defines each step of the missile life cycle where the threat may be negated (i.e., "killed"). For example, the kill chain could include the following steps: system engineering design, supply chain, manufacturing, quality assurance, operations and maintenance, fielding and deployment, and flight (e.g., boost, mid-course, terminal), or any other steps. The processor 230 can use the model to determine the correct composite form for Equations (31) and (41)-(43) for a specific missile under attack and specific VT pairs 316. The processor 230 can execute the model using random numbers or other values from the PDFs that were provided to the processor 230. The processor 230 can combine PDFs to determine probability of eliminating the missile threat using the corresponding technique, wherein the combining can include performing a logical AND operation, a logical OR operation, or both a logical AND and a logical OR operation. The processor 230 can combine the PDFs using at least two combination methods, each of the at least two combination methods including different combinations of logical operations, and the processor 230 can provide a sensitivity analysis that compares probabilities using at least two combination methods.

The processor 230 can calculate various values or generate other data, for example the processor 230 can calculate the mean and confidence interval for $P_n$, as well as the PDF for $P_n$. The processor 230 can determine which parameters are driving $P_n$ to determine the sensitivity of each element on $P_n$. Operators or governmental agencies can use the models, data, and calculations generated using methods and apparatuses in accordance with various embodiments to make a determination to perform additional research into vulnerabilities, techniques, etc.

While some embodiments are described with respect to input devices, some embodiments allow for selection to be performed in an automated fashion by the processor 230, instead of or in addition to being performed through a user input. The selection provides an indication of the confidence level associated with the corresponding component to generate a set of selected PDFs. The processor 230 will combine selected PDFs to determine probability of eliminating the missile threat using the corresponding technique. The processor 230 may perform this combination according to various methods, including by performing a logical AND operation, a logical OR operation, or both a logical AND and a logical OR operation, although embodiments are not limited thereto. In some embodiments, the processor 230 may combine the PDFs using at least two combination methods, each of the at least two combination methods including different combinations of logical operations, to perform a sensitivity analysis to compare probabilities using each of the at least two combination methods.

The computer 200 includes memory 220. In one embodiment, the memory 220 includes, but is not limited to, random access memory (RAM), dynamic RAM (DRAM), static RAM (SRAM), synchronous DRAM (SDRAM), double data rate (DDR) SDRAM (DDR-SDRAM), or any device capable of supporting high-speed buffering of data. The memory 220 can store, for example, accumulated images and at least a subset of frames of the video data.

The computer 200 can include computer instructions 240 that, when implemented on the computer 200, cause the computer 200 to implement functionality in accordance with example embodiments. The instructions 240 can be stored on a computer-readable storage device, which can be read and executed by at least one processor 230 to perform the operations described herein. In some embodiments, the instructions 240 are stored on the processor 230 or the memory 220 such that the processor 230 or the memory 220 acts as computer-readable media. A computer-readable storage device can include any non-transitory mechanism for storing information in a form readable by a machine (e.g., a computer). For example, a computer-readable storage device can include ROM, RAM, magnetic disk storage media, optical storage media, flash-memory devices, and other storage devices and media.

The instructions 240 can, when executed on the computer 200, cause the computer 200 to identify a vulnerability 304 (FIG. 3) associated with a missile threat, as described earlier herein. The instructions can cause the computer 200 to identify a technique 318 (FIG. 3) for exploiting the vulnerability 304 (FIG. 3) to generate a vulnerability-technique (VT) pair 316 (FIG. 3). The instructions 240 can cause the computer 200 to apply an SMM to generate a negation value $P_n$, the negation value $P_n$ being representative of a probability that the technique 318 of the respective VT pair 316 will eliminate the threat by exploiting the vulnerability 304. The instructions 240 can cause the computer 200 to provide a recommendation for implementing the technique 318 to eliminate the missile threat responsive to receiving a selection of the technique 318, where the selection is based on the generated negation value $P_n$. Various portions of embodiments can be implemented, concurrently or sequentially, on parallel processors using technologies such as multi-threading capabilities.

Figure 5:
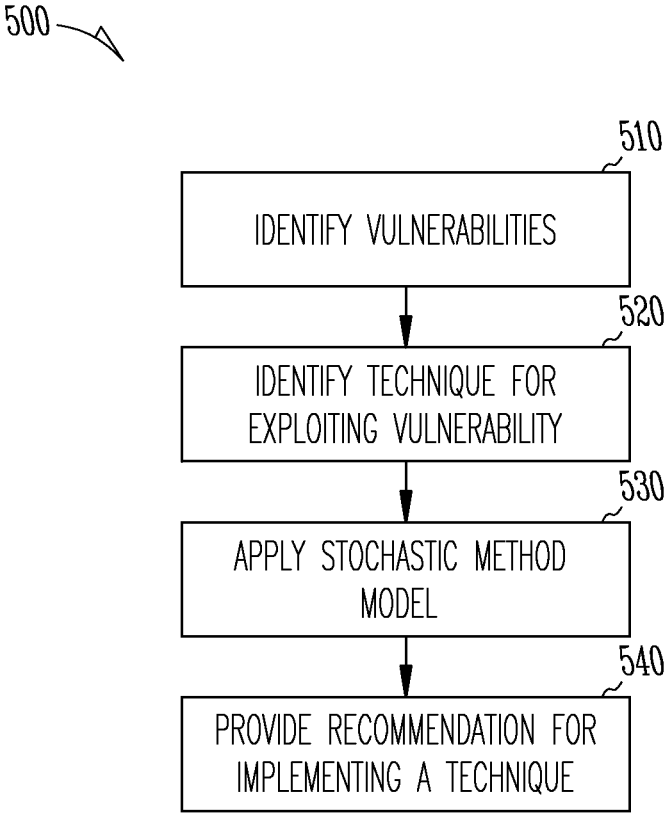
FIG. 5 illustrates an example procedure for eliminating a missile threat in accordance with some embodiments.

FIG. 5 illustrates an example procedure 500 for eliminating a missile threat in accordance with some embodiments. The method may be performed by, for example, the processor 230 as described above and can be based on techniques 318, vulnerabilities 304, and VT pairs 316 as described above.

In operation 510, the processor 230 identifies a vulnerability 304 associated with the missile threat. As described earlier with reference to FIG. 2, information identifying the vulnerability 304 may be received through a communication interface 210 or retrieved from memory in some embodiments, although embodiments are not limited thereto.

In operation 520, the processor 230 identifies a technique 318 for exploiting the vulnerability 304 to generate a VT pair 316, as described earlier herein with reference to FIG. 3. There technique 318 can be selected from a set of non-kinetic techniques that include directed energy (DE) techniques, electronic warfare (EW) techniques, and cyber warfare techniques, although embodiments are not limited thereto.

In operation 530, the processor 230 applies an SMM to generate a negation value $P_n$. The negation value $P_n$ may represent a probability that the technique 318 of the respective VT pair 316 will eliminate the threat by exploiting the vulnerability 304. The negation value $P_n$ may be generated as described earlier herein with reference to Equations (1)-(7) and can include a plurality of components.

The processor 230 will generate a set of PDFs for each of the plurality of components. Each PDF in one set will represent a different confidence level associated with the corresponding component. The processor 230 will provide graphical representations for each set of PDFs. The graphical representations may be similar to those described earlier herein with reference to FIG. 4. As described earlier herein with reference to FIG. 4, the processor 230 will receive a selection of one PDF from each set of PDFs, wherein the selection provides an indication of the confidence level associated with the corresponding component. The processor 230 will combine the selected PDFs, according to one of the methods described earlier herein, to determine probability of eliminating the missile threat using the corresponding technique 318.

In operation 540, the processor 230 provides a recommendation for implementing the technique 318 to eliminate the missile threat responsive to receiving a selection of the technique 318. The selection may be selected based on the generated negation value $P_n$.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A computer-implemented method for eliminating a missile threat prior to a launch of a manufactured missile, the method comprising:

receiving vulnerability identification information, via a computer communications interface, identifying a pre-launch vulnerability associated with the missile threat of the manufactured missile;

receiving technique identification information, via the computer communications interface, identifying a technique for exploiting the pre-launch vulnerability to generate a vulnerability-technique (VT) pair, the technique selected from a set of non-kinetic techniques that include directed energy (DE) techniques and electronic warfare (EW) techniques, and comprising, during a test phase or a deployment phase of the manufactured missile, at least one of inducing material defects, disrupting logistics, inducing failures during hardware and software upgrades, and affecting calibration and maintenance;

applying a stochastic mathematical model (SMM), by a processor, to generate a negation value that represents a probability that the technique of the respective VT pair will eliminate the missile threat prior to launch by exploiting the pre-launch vulnerability, wherein applying the SMM comprises:

generating a plurality of components to represent the negation value, each component to represent a different criterion for estimating a probability that implementation of the technique will eliminate the missile threat;

generating a set of probability distribution functions (PDF) for each of the plurality of components, each PDF in one set representing a different confidence level associated with the corresponding component;

automatically selecting, by a processor, one PDF from each set of PDFs, wherein the selection provides an indication of the confidence level associated with the corresponding component, to generate a set of selected PDFs; and combining the one or more selected PDFs to determine probability of eliminating the missile threat using the corresponding technique; and providing, by a processor, on a display, a recommendation for implementing the technique to eliminate the missile threat prior to launch responsive to receiving the selection of the technique, the selection being responsive to the negation value.

2. The method of claim 1, wherein each criterion is selected from a list including one or a combination of:

a placement criterion to represent whether an instrumentality for executing the technique can be placed in a manner to exploit the pre-launch vulnerability;

an activation criterion to represent whether the technique can be activated subsequent to placement of the instrumentality for executing the technique;

a success criterion to represent whether implementation of the technique can exploit the corresponding pre-launch vulnerability; and a severity criterion to represent the severity with which the pre-launch vulnerability affects operation of the missile threat.

3. The method of claim 1, further comprising:

providing graphical representations for each set of PDFs on the display.

4. The method of claim 1, wherein the combining includes performing a logical AND operation, a logical OR operation, or both a logical AND and a logical OR operation.

5. The method of claim 4, wherein the method includes combining the PDFs using at least two combination methods, each of the at least two combination methods including different combinations of logical operations, and providing a sensitivity analysis to compare probabilities using each of the at least two combination methods.

6. The method of claim 1, further comprising:

generating a plurality of negation values based on a plurality of different VT pairs; and combining the plurality of negation values to compute the probability that execution of at least one of the techniques of the plurality of VT pairs will successfully exploit the pre-launch vulnerability to eliminate the missile threat.

7. An apparatus for eliminating a missile threat prior to a launch of a manufactured missile, the apparatus comprising:

a communication interface to receive:

identification information identifying a pre-launch vulnerability associated with the missile threat of the manufactured missile, and identification information identifying a technique for exploiting the pre-launch vulnerability to generate a vulnerability-technique (VT) pair, the technique selected from a set of non-kinetic techniques that include directed energy (DE) techniques and electronic warfare (EW) techniques, and comprising, during a test phase or a deployment phase of the manufactured missile, at least one of inducing material defects, disrupting logistics, inducing failures during hardware and software upgrades, and affecting calibration and maintenance, one or more processors to:

apply a stochastic mathematical model (SMM) to generate a negation value that represents a probability that the technique of the respective VT pair will eliminate the missile threat prior to launch by exploiting the pre-launch vulnerability, wherein applying the SMM comprises:

generating a plurality of components to represent the negation value, each component to represent a different criterion for estimating a probability that implementation of the technique will eliminate the missile threat;

generating a set of probability distribution functions (PDF) for each of the plurality of components, each PDF in one set representing a different confidence level associated with the corresponding component;

automatically selecting, by a processor, one PDF from each set of PDFs, wherein the selection provides an indication of the confidence level associated with the corresponding component, to generate a set of selected PDFs; and combining the one or more selected PDFs to determine probability of eliminating the missile threat using the corresponding technique; and provide a recommendation for implementing the technique to eliminate the missile threat prior to launch responsive to receiving the selection of the technique, the selection being responsive to the generated negation value; and a display to display the recommendation.

8. The apparatus of claim 7, further comprising:

an input device, and wherein the input device provides an input to the one or more processors representing the selection of the technique from the set of non-kinetic techniques that include directed energy (DE) techniques and electronic warfare (EW) techniques.

9. The apparatus of claim 7, wherein each criterion is selected from a list including one or a combination of:

a placement criterion to represent whether an instrumentality for executing the technique can be placed in a manner to exploit the pre-launch vulnerability;

an activation criterion to represent whether the technique can be activated subsequent to placement of the instrumentality for executing the technique;

a success criterion to represent whether implementation of the technique can exploit the corresponding pre-launch vulnerability; and a severity criterion to represent the severity with which the pre-launch vulnerability affects operation of the missile threat.

10. The apparatus of claim 7, wherein the one or more processors are further configured to:

combine the one or more selected PDFs, by performing a logical AND operation, a logical OR operation, or both a logical AND and a logical OR operation, to determine probability of eliminating the missile threat using the corresponding technique.

11. The apparatus of claim 10, wherein the one or more processors are further configured to combine the PDFs using at least two combination methods, each of the at least two combination methods including different combinations of logical operations, and providing sensitivity analysis to compare probabilities using each of the at least two combination methods.

12. The apparatus of claim 7, wherein the one or more processors are further configured to:

generate a plurality of negation values based on a plurality of different VT pairs; and combine the plurality of negation values to compute the probability that execution of at least one of the techniques of the plurality of VT pairs will successfully exploit the pre-launch vulnerability to eliminate the missile threat.

13. A non-transitory computer-readable medium storing instructions that, when executed on a machine, cause the machine to eliminate a missile threat prior to a launch of a manufactured missile by performing operations comprising:

identifying a pre-launch vulnerability associated with the missile threat of the manufactured missile;

identifying a technique for exploiting the pre-launch vulnerability to generate a vulnerability-technique (VT) pair, the technique selected from a set of non-kinetic techniques that include directed energy (DE) techniques and electronic warfare (EW) techniques, and comprising, during a test phase or a deployment phase of the manufactured missile, at least one of inducing material defects, disrupting logistics, inducing failures during hardware and software upgrades, and affecting calibration and maintenance;

applying a stochastic mathematical model (SMM) to generate a negation value that represents a probability that the technique of the respective VT pair will eliminate the missile threat prior to launch by exploiting the pre-launch vulnerability, wherein applying the SMM comprises:

generating a plurality of components to represent the negation value, each component to represent a different criterion for estimating a probability that implementation of the technique will eliminate the missile threat;

generating a set of probability distribution functions (PDF) for each of the plurality of components, each PDF in one set representing a different confidence level associated with the corresponding component;

automatically selecting, by a processor, one PDF from each set of PDFs, wherein the selection provides an indication of the confidence level associated with the corresponding component, to generate a set of selected PDFs; and combining the one or more selected PDFs to determine probability of eliminating the missile threat using the corresponding technique; and providing, on a display, a recommendation for implementing the technique to eliminate the missile threat prior to launch responsive to receiving a selection of the technique, the selection being responsive to the generated negation value.

14. The non-transitory computer-readable medium of claim 13, wherein each criterion is selected from a list including one or a combination of:

a placement criterion to represent whether an instrumentality for executing the technique can be placed in a manner to exploit the pre-launch vulnerability, an activation criterion to represent whether the technique can be activated subsequent to placement of the instrumentality for executing the technique;

a success criterion to represent whether implementation of the technique can exploit the corresponding pre-launch vulnerability; and a severity criterion to represent the severity with which the pre-launch vulnerability affects operation of the missile threat.

15. The non-transitory computer-readable medium of claim 13, further comprising instructions that, when implemented on the machine, cause the machine to:

combine the one or more selected PDFs, by performing a logical AND operation, a logical OR operation, or both a logical AND and a logical OR operation, to determine probability of eliminating the missile threat using the corresponding technique.

16. The non-transitory computer-readable medium of claim 13, further comprising instructions that, when implemented on the machine, cause the machine to combine the PDFs using at least two combination methods, each of the at least two combination methods including different combinations of logical operations, and providing sensitivity analysis to compare probabilities using each of the at least two combination methods.

* * * * *